US009653816B2

(12) United States Patent
Ferreri et al.

(10) Patent No.: US 9,653,816 B2
(45) Date of Patent: May 16, 2017

(54) ANTENNA SYSTEM

(71) Applicants: Arnold L. Ferreri, Hicksville, NY (US); Charles L. Dietz, Stuart, FL (US); Patrick J. Knowles, Baltimore, MD (US)

(72) Inventors: Arnold L. Ferreri, Hicksville, NY (US); Charles L. Dietz, Stuart, FL (US); Patrick J. Knowles, Baltimore, MD (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 230 days.

(21) Appl. No.: 14/330,849

(22) Filed: Jul. 14, 2014

(65) Prior Publication Data

US 2016/0013564 A1 Jan. 14, 2016

(51) Int. Cl.

| | |
|---|---|
| ***H01Q 21/06*** | (2006.01) |
| ***H01Q 1/42*** | (2006.01) |
| ***H01Q 19/06*** | (2006.01) |
| ***H01Q 15/24*** | (2006.01) |
| ***H01Q 1/28*** | (2006.01) |
| ***H01Q 21/20*** | (2006.01) |

(Continued)

(52) U.S. Cl.

CPC ..... *H01Q 21/061* (2013.01); *H01Q 1/28* (2013.01); *H01Q 1/282* (2013.01); *H01Q 1/286* (2013.01); *H01Q 1/287* (2013.01); *H01Q 1/42* (2013.01); *H01Q 15/24* (2013.01); *H01Q 19/062* (2013.01); *H01Q 21/205* (2013.01); *H01Q 21/24* (2013.01); *H01Q 25/00* (2013.01); *H01Q 25/005* (2013.01)

(58) Field of Classification Search

CPC ..... H01Q 1/42; H01Q 21/061; H01Q 1/28; H01Q 1/282; H01Q 1/286; H01Q 1/287

USPC ..... 343/893, 872, 753, 705, 706, 708

See application file for complete search history.

(56) References Cited

U.S. PATENT DOCUMENTS 2,980,909 A * 4/1961 Clanton, Jr. ..... H01Q 1/428 343/705
3,026,516 A * 3/1962 Davis ..... B64C 1/36 343/705

(Continued)

FOREIGN PATENT DOCUMENTS

CN 101364672 A 4/2012
WO WO 02/31908 A2 4/2002

(Continued)

OTHER PUBLICATIONS

Bibl: "*Triangular Antenna Arrays for HF*"; Antennas and Propagation, Apr. 4-7, 1995, Conference Publication No. 407, © IEE 1995, pp. 204-2007.

(Continued)

*Primary Examiner* — Dameon E Levi
*Assistant Examiner* — Ab Salam Alkassim, Jr.
(74) *Attorney, Agent, or Firm* — Tarolli, Sundheim, Covell & Tummino LLP

(57) ABSTRACT

An antenna system can include a first panel of radiators that extend from a vertex in a first substantially linear direction. The antenna system can also include a second panel of radiators extending from the vertex in a second substantially linear direction. The first panel of radiators and the second panel of radiators form an angle between about 1 degree and about 45 degrees to enhance gain.

17 Claims, 14 Drawing Sheets

(51) Int. Cl.
*H01Q 21/24* (2006.01)
*H01Q 25/00* (2006.01)

(56) References Cited

U.S. PATENT DOCUMENTS

| | | | | |
|---|---|---|---|---|
| 3,045,236 | A * | 7/1962 | Colman | H01Q 1/428 343/705 |
| 3,099,836 | A | 7/1963 | Carr | |
| 4,122,447 | A | 10/1978 | Kawai et al. | |
| 5,049,891 | A * | 9/1991 | Ettinger | H01Q 1/28 343/705 |
| 5,191,351 | A * | 3/1993 | Hofer | H01Q 1/36 343/708 |
| 5,220,330 | A * | 6/1993 | Salvail | H01Q 1/281 342/374 |
| 5,619,216 | A | 4/1997 | Park | |
| 5,714,961 | A | 2/1998 | Kot et al. | |
| 5,874,915 | A * | 2/1999 | Lee | H01Q 3/242 342/372 |
| 6,400,337 | B1 | 6/2002 | Handelsman | |
| 7,855,690 | B2 * | 12/2010 | Hook | H01Q 1/38 343/754 |
| 8,253,641 | B1 * | 8/2012 | Waterman | H01Q 21/061 343/772 |
| 8,294,631 | B2 | 10/2012 | Croston | |
| 8,319,688 | B2 | 11/2012 | Parsche | |
| 2003/0020666 | A1 * | 1/2003 | Wright | H01Q 1/286 343/824 |
| 2007/0060046 | A1 * | 3/2007 | Lee | H01Q 1/007 455/7 |
| 2007/0257858 | A1 * | 11/2007 | Liu | H01Q 1/007 343/893 |
| 2009/0135076 | A1 | 5/2009 | Foo | |
| 2009/0303147 | A1 * | 12/2009 | Choudhury | H01Q 13/0283 343/776 |
| 2010/0018301 | A1 * | 1/2010 | Lutke | B64C 1/36 73/118.03 |
| 2010/0141551 | A1 * | 6/2010 | Peng | H01Q 13/08 343/893 |
| 2013/0182790 | A1 * | 7/2013 | Jalali | H01Q 3/24 375/285 |
| 2013/0214972 | A1 * | 8/2013 | Woodell | H01Q 1/281 342/372 |
| 2014/0159949 | A1 * | 6/2014 | Mialhe | H01Q 1/281 342/26 B |

FOREIGN PATENT DOCUMENTS

| | | | |
|---|---|---|---|
| WO | WO 03/098943 | A1 | 11/2003 |
| WO | WO 2004/093416 | A1 | 10/2004 |
| WO | WO 2005/039074 | A1 | 4/2005 |
| WO | WO 2009/036305 | A1 | 3/2009 |
| WO | WO 2012/102576 | A2 | 8/2012 |

OTHER PUBLICATIONS

Nahar, et al.: "*Wideband Antenna Array Beam Steering with Free-Space Optical True-Time Delay Engine*"; IET Micro. Antennas Propag., 2011, vol. 5, Iss. 6, pp. 740-746; doi: 10.1049/iet-map.2010.0251.

Sharp: "*A Triangular Arrangement of Planar-Array Elements that Reduces the Number Needed*"; IRE Transactions on Antennas and Propagation; Mar. 1961, pp. 126-129.

Yun, et al.: "*Slot-Wedge Multiple-Element Antennas"; Antennas and Propagation Society International Symposium* (*APSURSI*), *2010 IEEE*, vol., No., pp. 1,4, Jul. 11-17, 2010 doi: 10.1109/APS.2010.5561147 URL: http://ieeexplore.ieee.org/stamp/stamp.jsp?tp=&arnumber=5561147&isnumber=5560891.

Cavallo, et al.: "*A 3- to 5-GHz Wideband Array of Connected Dipoles with Low Cross Polarization and Wide-Scan Capability*"; IEEE Transactions on Antennas and Propagation, vol. 6, No. 3, Mar. 2013, pp. 1148-1154.

International Search Report and Written Opinion for corresponding PCT/US2015/038094 dated Oct. 1, 2015; Completed by Officer Michael Unterberger on Sep. 22, 2015.

* cited by examiner

ANTENNA SYSTEM

TECHNICAL FIELD

This disclosure relates to an antenna system. More particularly, this disclosure relates to an antenna system with multi-modal radiators.

BACKGROUND

An antenna (or aerial) is an electrical device that converts electric power into radio waves, and vice versa. An antenna can be used with a radio transmitter and/or radio receiver. In transmission, a radio transmitter supplies an oscillating radio frequency electric current to the antenna's terminals, and the antenna radiates the energy from the current as electromagnetic waves (radio waves). In reception, an antenna intercepts some of the power of an electromagnetic wave in order to produce a small voltage at the antenna's terminals that is applied to a receiver to be amplified. An antenna's radiation pattern (also referred to as an antenna pattern or far-field pattern) can refer to the directional (angular) dependence of the strength of the radio waves from the antenna.

SUMMARY

One example relates to an antenna system that can include a first panel of radiators that extend from a vertex in a first substantially linear direction. The antenna system can also include a second panel of radiators extending from the vertex in a second substantially linear direction. The first panel of radiators and the second panel of radiators form an angle between about 1 degree and about 45 degrees.

Another example relates to an antenna system that can include a plurality of wedge shaped antenna arrays. Each of the wedge shaped antenna arrays can include a first two-dimensional panel of radiators extending from a vertex in a first substantially linear direction. The antenna system can also include a second two-dimensional panel of radiators extending from the vertex in a second substantially linear direction. The first two-dimensional panel of radiators and the second two-dimensional panel of radiators can form an angle between about 1 degree and about 45 degree. The antenna system can have an effective aperture equal to about a sum of the lengths of the first and second two-dimensional panels of radiators.

Yet another example relates to an antenna system. The antenna system can include a plurality of wedge shaped antenna arrays arranged in a shape with radial symmetry. Each of the wedge shaped antenna arrays can include a first two-dimensional panel of radiators extending from a vertex in a first substantially linear direction and a second two-dimensional panel of radiators extending from the vertex in a second substantially linear direction. The first two-dimensional panel of radiators and the second two-dimensional panel of radiators form an angle between about 1 degree and about 45 degrees. The plurality of wedge shaped antenna arrays can be arranged in one of a planar geometry a circular geometry and a cylindrical geometry.

DETAILED DESCRIPTION

A wideband electronically scanned array (WESA) wedge aperture can be employed in broadside and/or end-fire mode in both an arc shaped and linear arrangement of any WESA aperture size length and height necessary to achieve an intended antenna gain in order to detect objects in free-space. The WESA wedge aperture can be arranged in a polygonal configuration to form a geometrical structure with three vertices and three sides, which forms side panels. The side panels can be positioned in an X-Y plane and can include a plurality of multi-modal radiators (MMRs) (e.g., antenna elements) that can radiate electromagnetic energy (into free-space) in either a horizontal or vertical polarization. The ground planes of each respective side panel can be coupled together at a vertex of the WESA wedge aperture.

Figure 1:
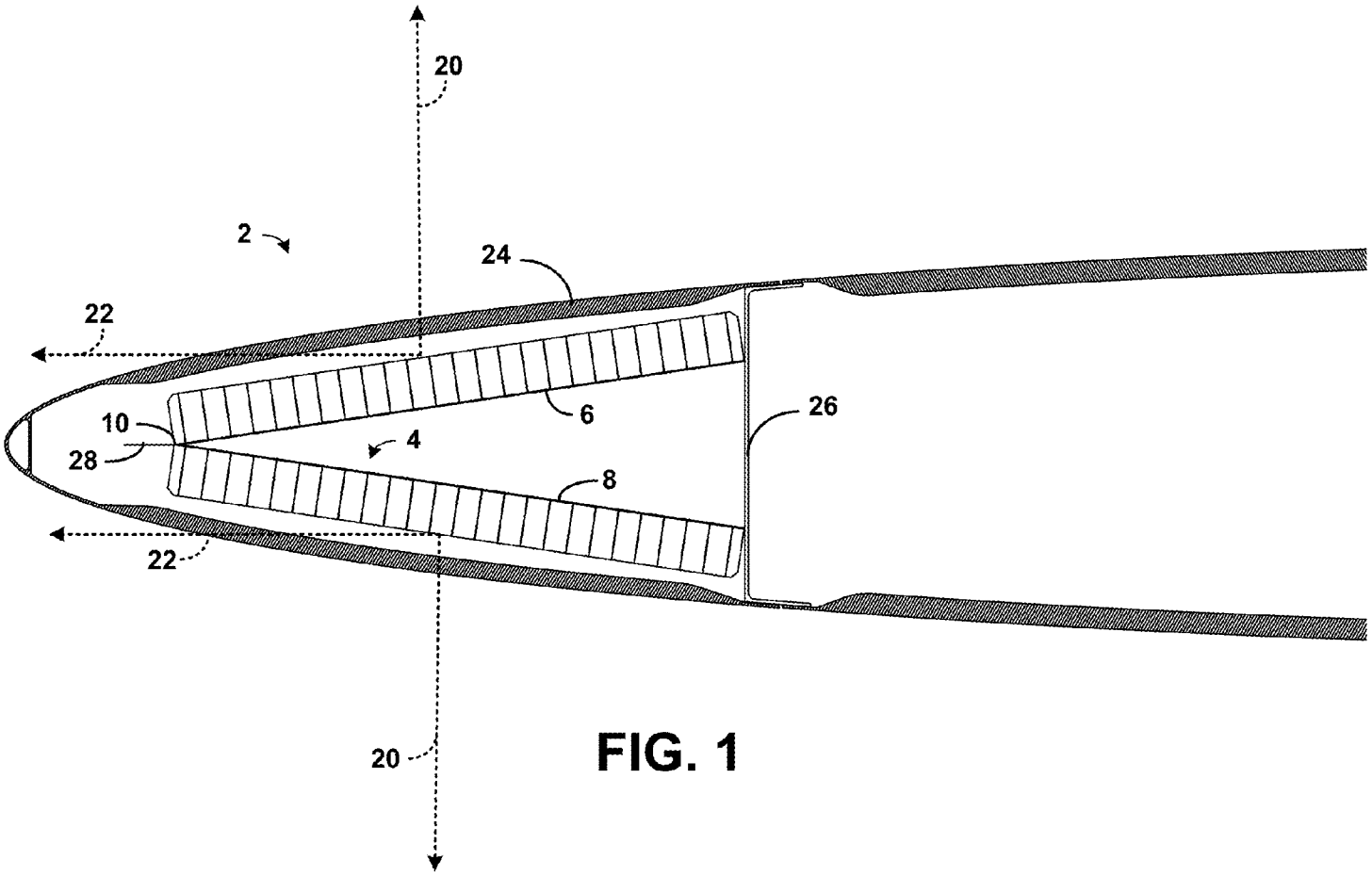
FIG. 1 illustrates an example of a section of an antenna system that can transmit a beam on demand (BOD) in multiple directions.

FIG. 1 illustrates an example of an antenna system 2 that can transmit a beam on demand (BOD) in multiple directions. As used herein, the term BOD can refer to the transmission or reception of electromagnetic waves that are propagated in a specific direction. The antenna system 2 can include a wedge shaped (e.g., a knife edge) antenna array 4 that can include, for example, an array of antenna elements. The wedge shaped antenna array 4 can be implemented, for example as a WESA wedge aperture. The wedge shaped antenna array 4 could be formed, for example, of a first panel 6 of antenna elements and a second panel 8 of antenna elements that intersect at a vertex 10. The angle between the first panel 6 of antenna elements and the second panel 8 of antenna elements could be, for example, between about 1° and about 45°.

Figure 2:
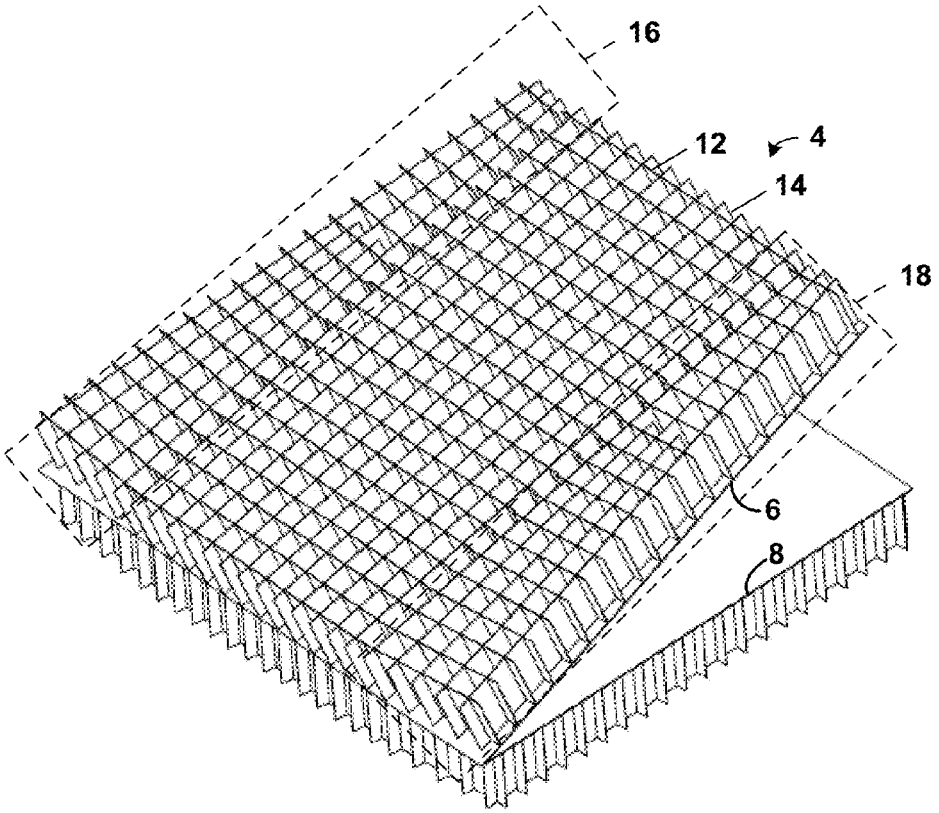
FIG. 2 illustrates a three dimensional view of a segment of wedge shaped antenna array of an antenna system.

FIG. 2 illustrates a three dimensional view of the wedge shaped antenna array 4 illustrated in FIG. 1. For purposes of simplification of explanation, the same reference numbers are employed in FIGS. 1 and 2 to denote the same structure. Each of the first panel 6 and the second panel 8 can include strips of multi-modal radiators (MMRs) 12 that are arranged substantially in parallel. It is noted that throughout this disclosure, examples of the employment of MMRs (such as the MMRs 12) are given. However, in any such example given in this disclosure, other radiators, (e.g., monopoles, dipoles, slots, etc.) could be employed. Each of the first and second panels 6 and 8 can also include a second set of MMRs 14 that are arranged substantially in parallel. The first and second panels 6 and 8 can include two tapered regions 16 and 18 that have (non-parallel) strips of MMRs arranged to a reduced width at an end distal to the vertex. The first set of strips of MMRs 12 and the second set of strips of MMRs 14 can be arranged to extend in a first direction and the second set of MMRs can be arranged to extend in a second direction that is perpendicular to the first direction. In this manner, the first set of strips of MMRs 12 and the second set of strips of MMRs 14 taken together can have an egg carton shape. The arrangement of the first set of strips of MMRs 12 and the second set of strips of MMRs 14 can result in the antenna system 2 being overpopulated, such that there can be several hundred to several thousand MMRs (e.g., antenna elements) in the wedge shaped antenna array. Each MMR of a strip of MMRs 12 or 14 can be implemented as a wideband antenna element. As explained, by arranging multiple MMRs, the antenna system 2 can be configured for dual polarization (e.g., horizontal and vertical polarization).

Figure 3:
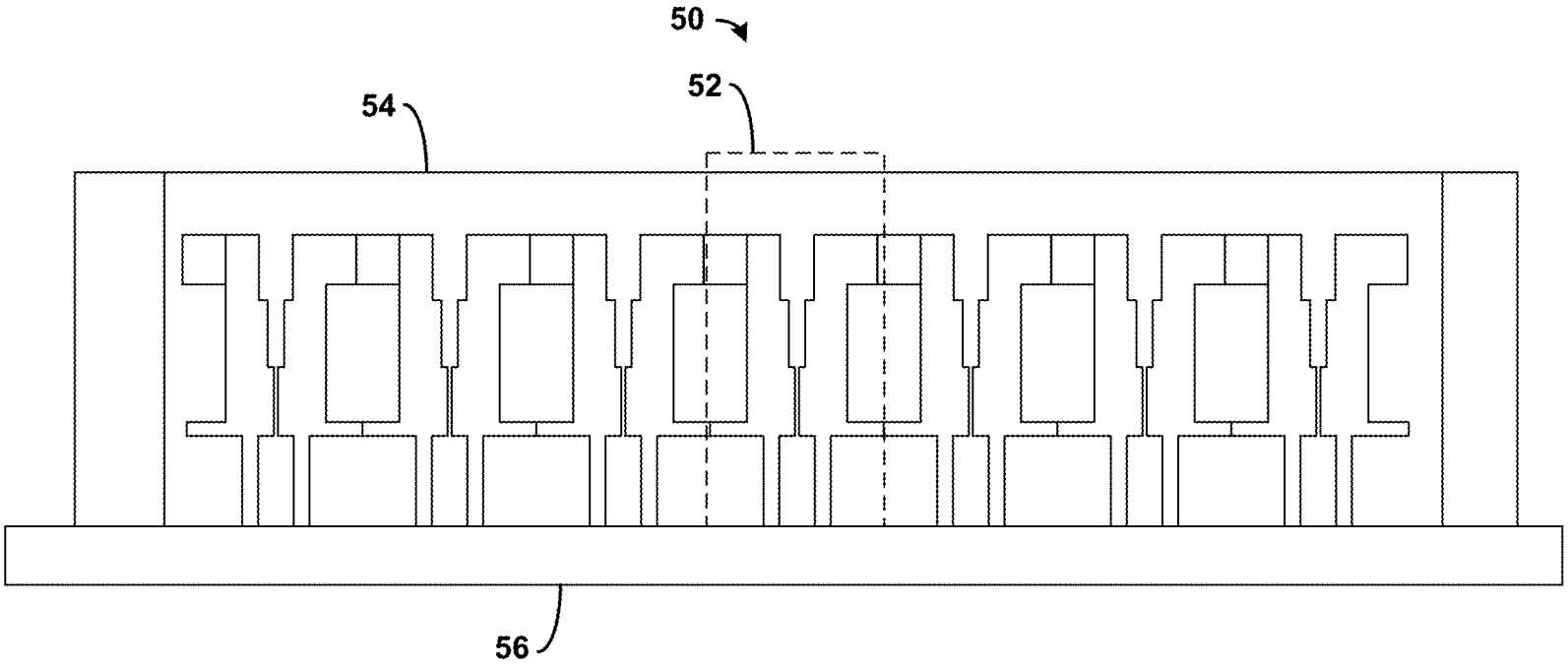
FIG. 3 illustrates an example of a multi-modal radiator (MMR) of an antenna system.

FIG. 3 illustrates an example of a strip of MMRs 50 that could be employed in the first set of strips of MMRs 12 and/or the second set of strips of MMRs 14 illustrated in FIG. 2. The strip of MMRs 50 can include a substrate 54 that can be formed of an insulating and/or intrinsic material, such as FR4, ceramic, fiberglass, etc. The substrate 54 can overlay a ground plane 56 that can be coupled to an electrically neutral node (e.g., chassis ground). Moreover, a plurality of MMRs, including the MMR 52 can be etched in the substrate 54 conducting surface.

Figure 4:
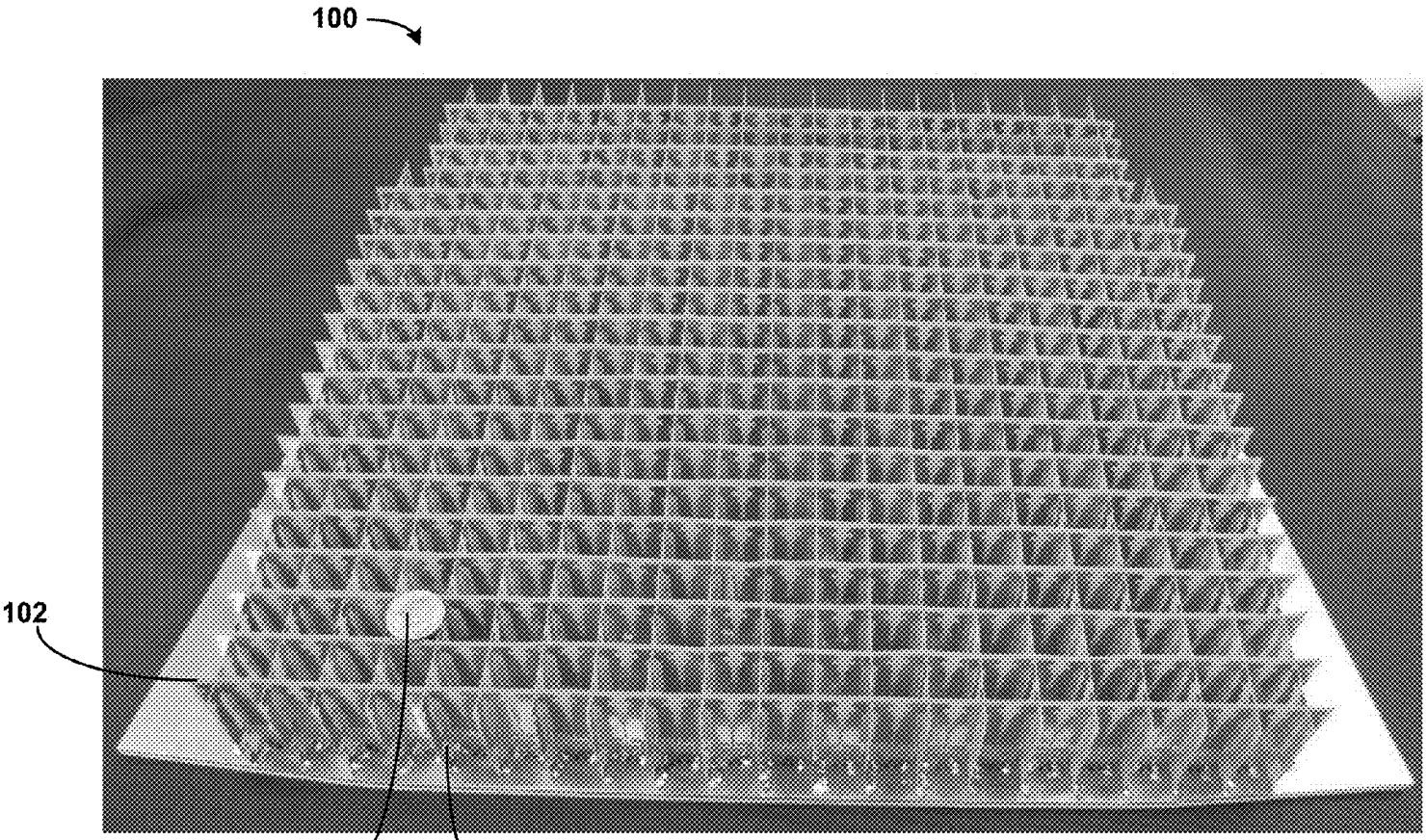
FIG. 4 illustrates a photograph of an example of a panel of MMRs
Figure 5:
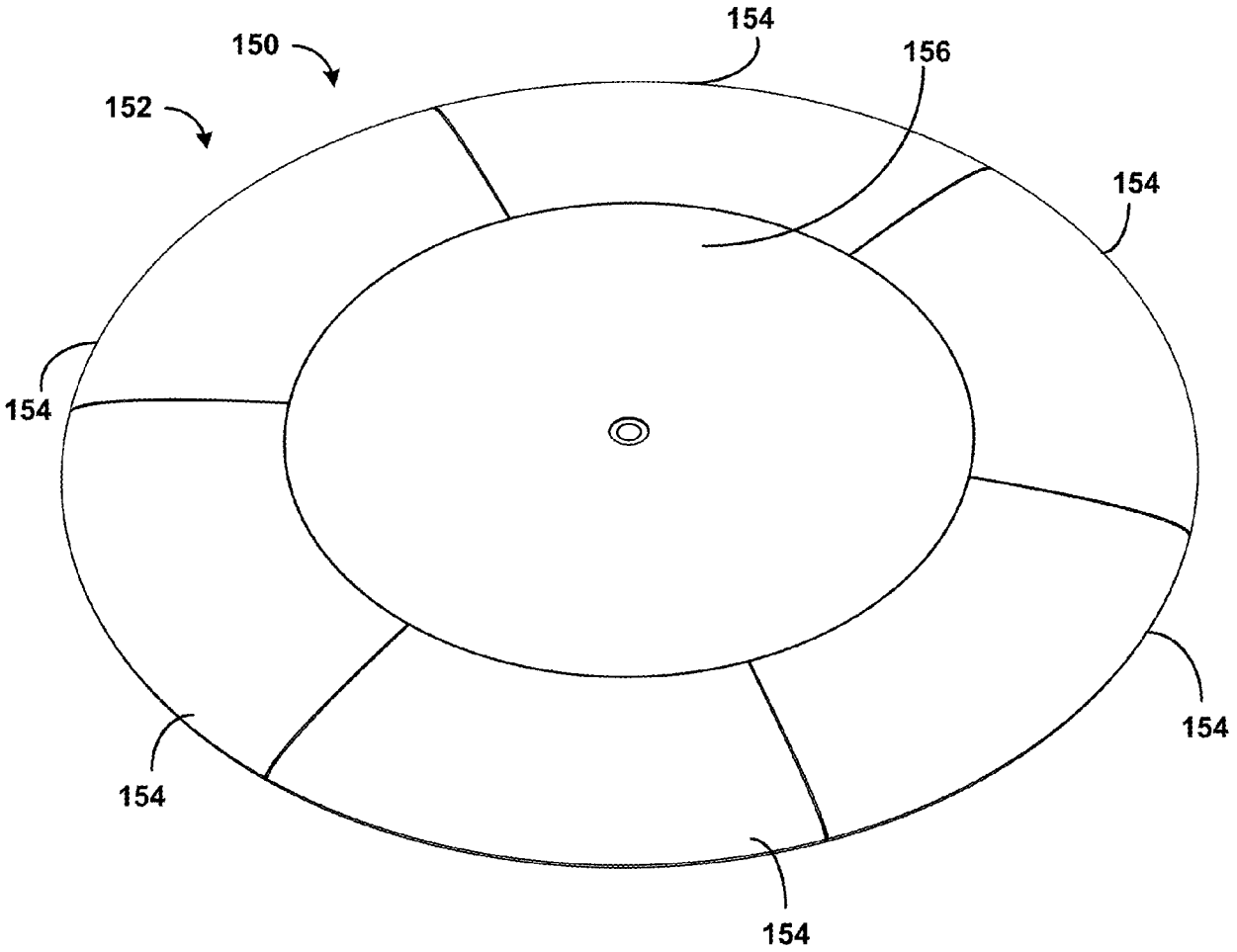
FIGS. 5-8 illustrate an example of an antenna system enclosed in a circular housing.

FIG. 4 illustrates a photograph depicting an example of a panel of MMRs 100 that could be employed, for example, as the first panel 6 or the second panel 8 illustrated in FIG. 2. The panel of MMRs 100 can include, a first set of strips of MMRs 102 arranged in parallel in a first direction and a second set of strips of MMRs 104 arranged in parallel in a second direction, wherein the first direction and the second direction are perpendicular to each other. Each of the MMRs can be implemented in a manner similar to the MMR 52 of FIG. 3. The photograph also includes a marker 106 (e.g., a coin) to provide a frame of reference of scale. As is illustrated, the panel of MMRs 100 has an egg carton shape. By arranging the panel of MMRs 100 in this manner, EM waves propagated can have orthogonal polarizations. It is to be understood that in other examples, the first and second sets of strips of MMRs 102 and 104 could be arranged in other orientations (e.g., non-parallel orientations, such as logarithmic, 45 degree, rhombic, triangular, etc.). In fact, the first and second strips of MMRs 102 and 104 can be arranged in nearly any configuration.

Referring back to FIG. 1, each of the first panel 6 and the second panel 8 in the antenna system 2 can receive an RF signal that can be broadcast in a broadside mode indicated by the arrow 20 (e.g., a vertical direction) and/or an end-fire mode (e.g., a horizontal directional) indicated by the arrow 22 or nearly any angle in between the broadside mode and the end-fire mode. Thus, by including the wedge shaped antenna array 4 in the antenna system 2, a beam can be output in nearly any elevation. Stated differently, the wedge shaped antenna array 4 can transmit a BOD that can have a polar angle that can vary by about 180° to achieve elevation diversity. The wedge shaped antenna array 4 could have an azimuth angle that varies to achieve azimuth diversity. Moreover, as explained herein, by combining multiple instances of the wedge shaped antenna array 4, the antenna system 2 can achieve both elevation diversity and azimuth diversity. For example, by arranging multiple instances of the wedge shaped antenna array 4, the antenna system 2 can extend in a linear direction, be arranged in an arc shape, achieve radial symmetry, etc.

The antenna system 2 could be enclosed in a housing 24. The housing 24 can be formed for example, by a material that is substantially transparent to electromagnetic (EM) radiation, such that EM waves can propagate through the housing 24 without significant attenuation. The wedge shaped antenna array 4 can be mounted, for example, on a truss structure 26. The antenna system 2 could be mounted on a vehicle, such as an aircraft or a terrestrial vehicle (e.g., a tank, a wheeled vehicle, etc.).

The antenna system 2 can operate over a relatively wide band (e.g., about 10:1). Employment of the wedge shaped antenna array 4 can provide an effective aperture that can allow for antenna operations that would otherwise require a significantly larger antenna. For example, the wedge shaped antenna array 4 can allow radiation and reception along an effective aperture equal to a combined length of first panel 6 and the second panel 8, while the height of the antenna can be about ½ the height (e.g., ¼ of the effective aperture) of a similarly sized cylindrical antenna. For instance, in one example, the BOD generated by the antenna system 2 can have a frequency in a range of about 400 megahertz (MHz) to about 3.5 gigahertz (GHz). Moreover, the wedge shaped antenna array 4 can be employed in situations where there is a relatively confined space in one plane available to position an antenna structure.

Figure 6:
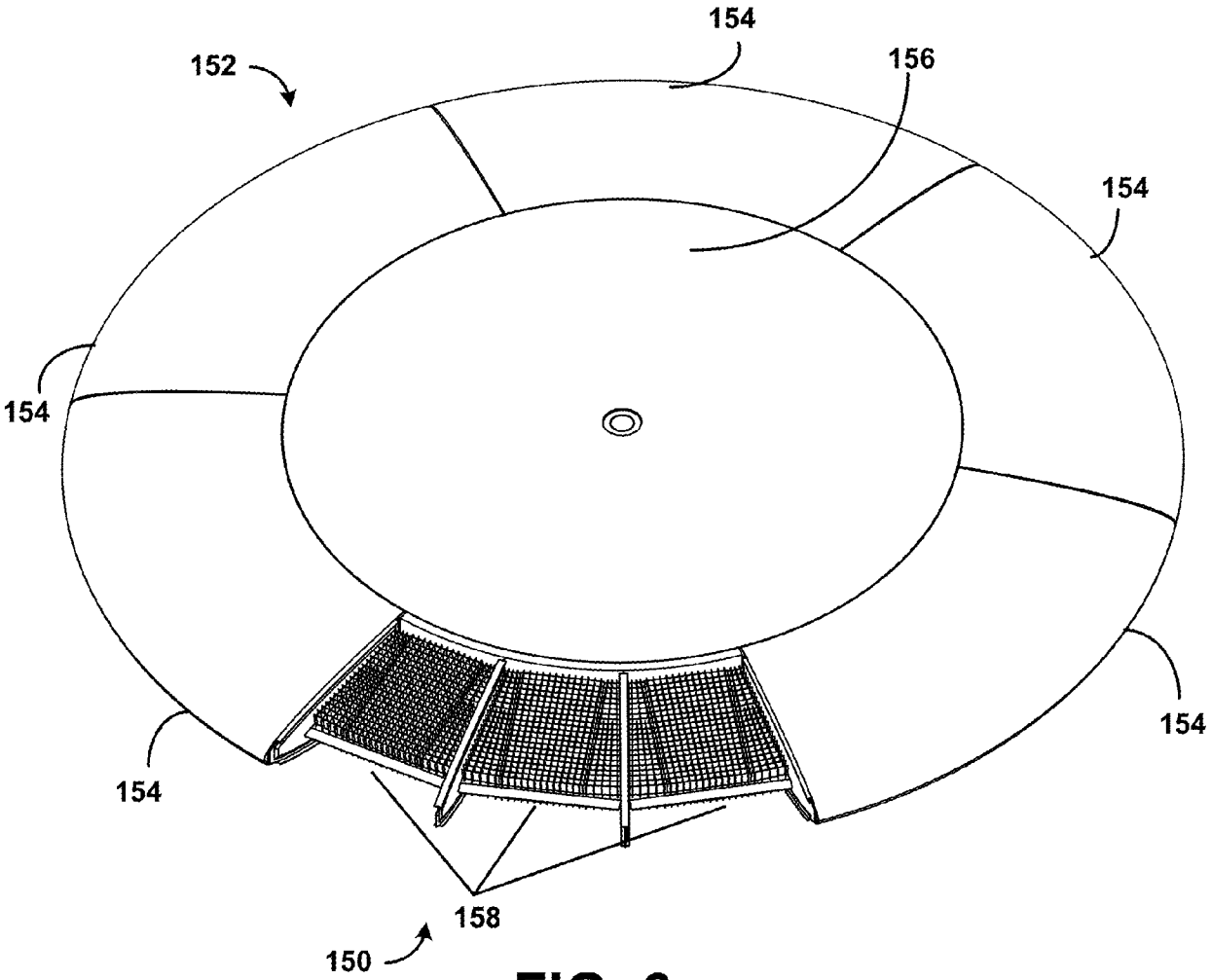
Figure 7:
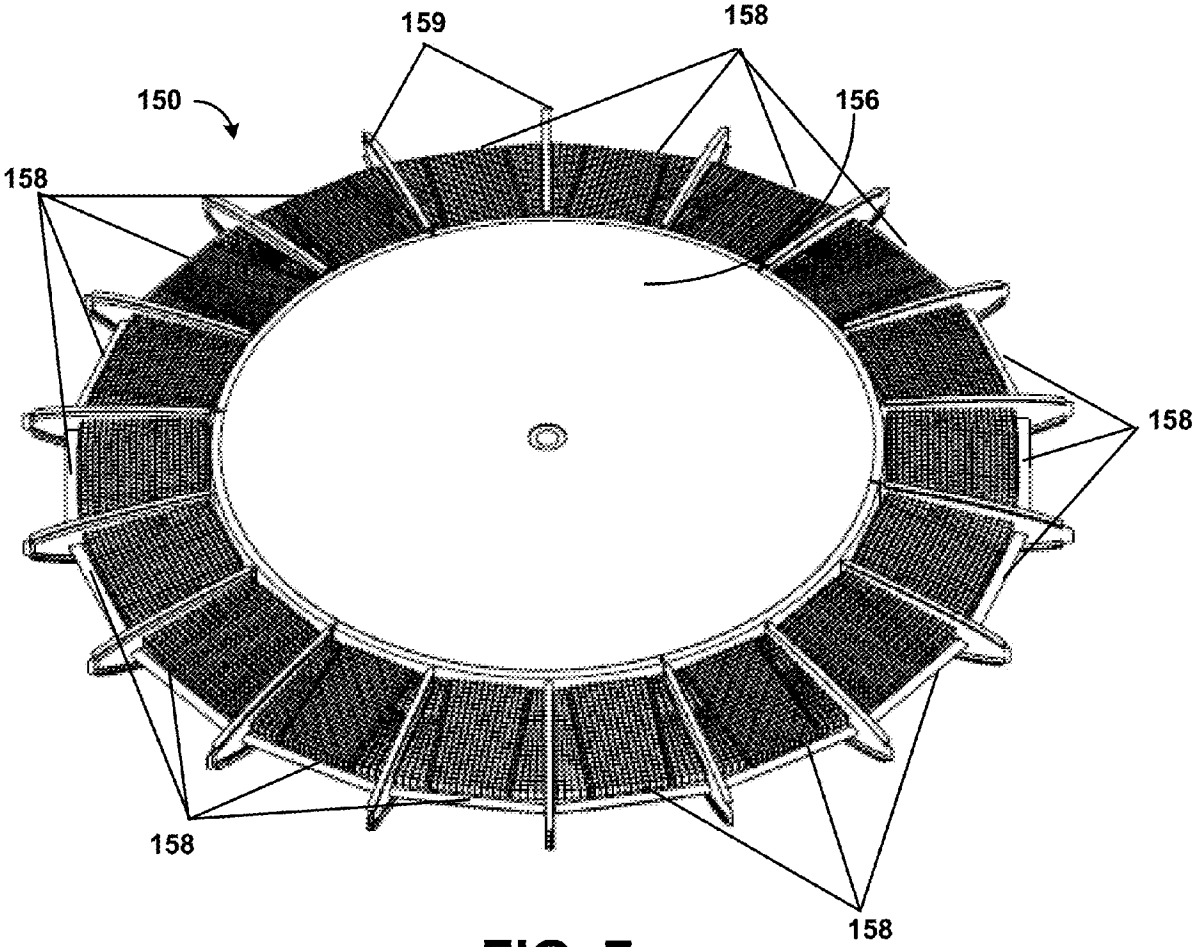
Figure 8:
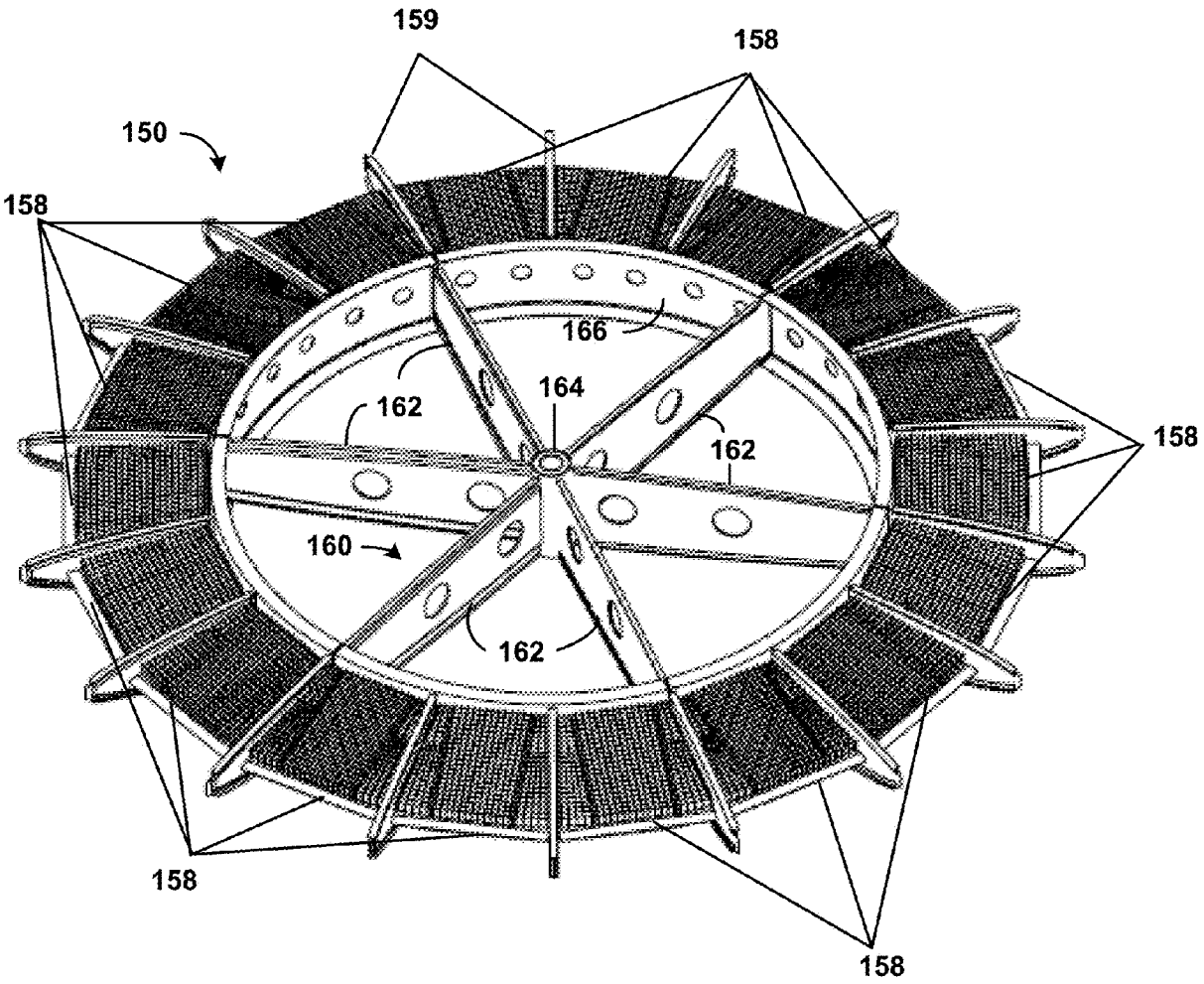

FIGS. 5-8 illustrate another example of an antenna system 150 enclosed in a housing 152. For purposes of simplification of explanation, FIGS. 5-8 employ the same reference numbers to denote the same structure. The housing 152 can be formed from a material that is substantially transparent to EM radiation, such as fiberglass. In the present example, the housing 152 has a circular shape. In other examples, other shapes could be employed. The housing 152 can be formed from a plurality of edge panels 154 and a center body 156. In some examples, the edge panels 154 and/or the center body 156 can be removable to facilitate maintenance of the antenna system 150. As is illustrated in FIGS. 6-8 some or all of the edge panels 154 and the center panel 156 have been removed.

As illustrated in FIG. 6, the antenna system 150 can include a plurality of wedge shaped antenna sub-arrays 158. Each of the wedge shaped antenna sub-arrays 158 could be implemented in a manner similar to the wedge shaped antenna array 4 illustrated in FIG. 1. Moreover, as is illustrated in FIG. 7, the wedge shaped antenna sub-arrays 158 can be affixed circumferentially, such that the antenna system 150 can have radial symmetry. The wedge shaped antenna arrays 158 can be separated from each other by RF transparent partitions 159 that extend outwardly from a center of the housing 152 between adjacent wedge shaped antenna arrays 158.

As is illustrated in FIG. 8, a truss system 160 can provide mechanical support for the wedge shaped antenna arrays 158. The truss system 160 can include, for example, a plurality of legs 162 that extend from a center region 164. The plurality of legs 162 can be affixed to a circular support member 166. In such a situation, each wedge shaped antenna array 158 can be affixed to the circular support member 166. The circular support member 166 can be implemented, for example as, as a sidewall. The truss structure can also include the partitions 159 that can separate instances of the wedge shaped antenna array 158. The partitions 159 can be affixed to the circular support member 166. The truss system 160 could be formed, for example, from a lightweight material, such as aluminum, but in other examples, other materials such as composites could be employed.

Referring back to FIG. 5, the housing 152 that includes the antenna system 150 can be mounted on a vehicle, such as an aircraft or a terrestrial vehicle. The antenna system 150 can transmit a BOD in nearly any direction. That is, as explained with respect to FIG. 1, each of the wedge shaped antenna arrays 158 can broadcast a beam in the broadside mode (e.g., a vertical direction) and/or in an end-fire mode (e.g., a horizontal direction) or anywhere in between. Accordingly, each of the wedge shaped antenna arrays 158 can broadcast a beam in with a polar angle that can vary by about 180° in a two-dimensional plane (e.g., elevation diversity). Thus, taken in the aggregate, the wedge shaped antenna arrays 158 arranged along a circumferential pattern (as is illustrated in FIG. 7), the antenna system 158 can broadcast a beam with a polar angle that can vary by about 180° (elevation diversity) and an azimuth angle that can vary about 360° in a two-dimensional plane (azimuth diversity). Accordingly, the antenna system 150 can provide a BOD in nearly any direction.

Figure 9:
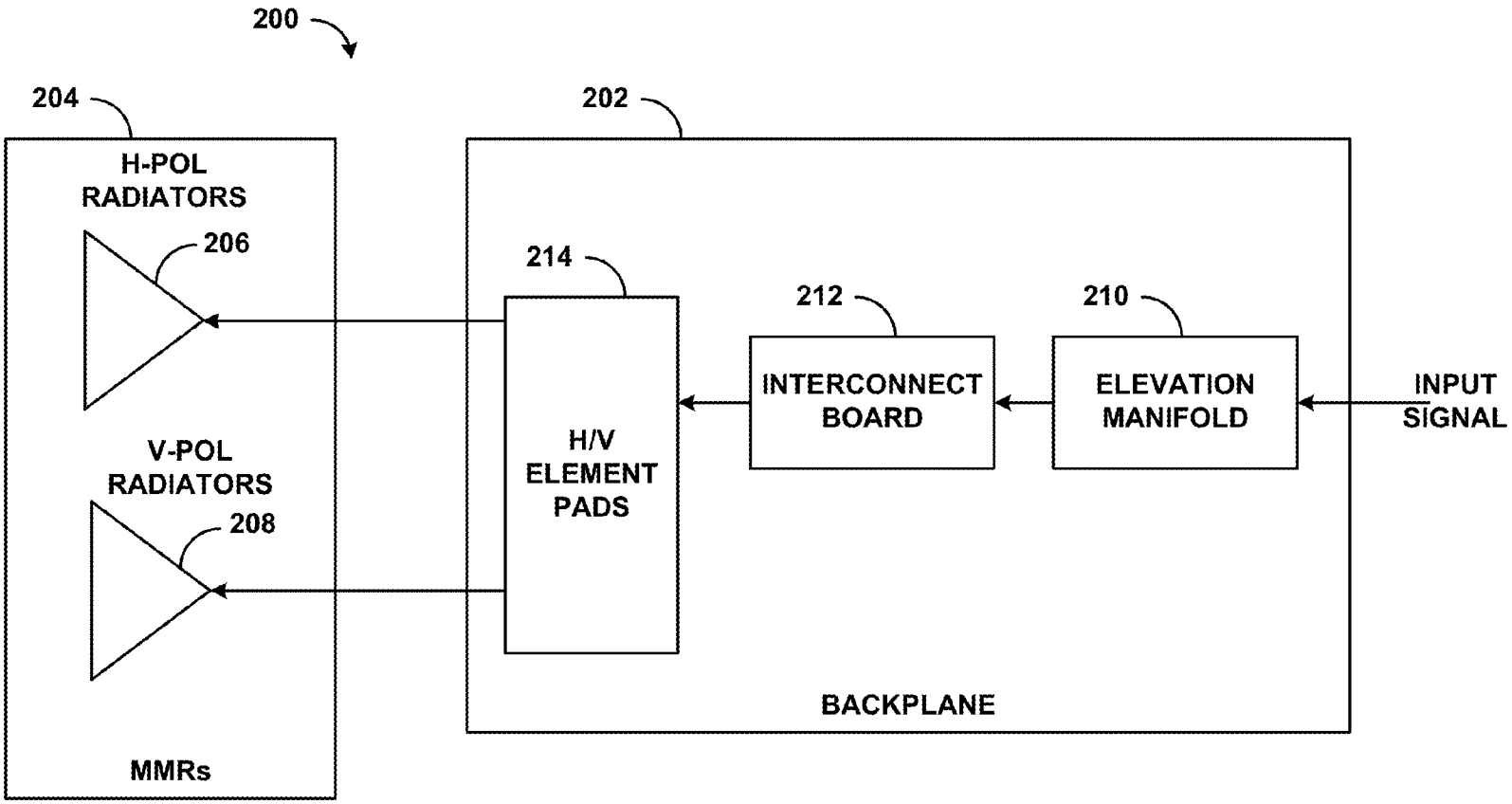
FIG. 9 illustrates an example of a system to feed an antenna system.

FIG. 9 illustrates an example of a feed system 200 that could be employed, for example to cause an antenna system (e.g., the antenna system 2 of FIG. 1 and/or the antenna system 150 of FIGS. 5-8) to transmit a BOD. The feedsystem 200 can include a backplane 202 that can be coupled to a plurality of MMRs 204. In one example, the MMRs 202 can include horizontally polarized radiators 206 and vertically polarized radiators 208. The horizontally polarized radiators 206 and the vertically polarized radiators 208 could each be implemented, for example as an instance of the MMR 52 illustrated in FIG. 3. Moreover, the horizontally polarized radiators 206 and the vertically polarized radiators 208 can be aligned orthogonally.

The backplane 202 can be configured to receive an input signal (labeled in FIG. 9 as "INPUT SIGNAL") at an elevation manifold 210. The input signal can feed, for example, a wedge shaped antenna array to generate a BOD. The elevation manifold 210 can be configured to control an interconnect board 212 based on the identification of the wedge shaped antenna array. Additionally, the interconnect board 212 can provide the input signal to corresponding horizontal and/or vertical element pads 214 that can be coupled to drive points on corresponding MMRs 204 of the horizontally polarized radiators 206 and/or the vertically polarized radiators 208. In this manner, the input signal can be distributed to the appropriate horizontally polarized radiators 206 and/or the appropriate vertically polarized radiators 208 to facilitate generation of a BOD in a desired direction based on the input signal. In some examples, the backplane 202 can be configured such that a subset of the horizontally polarized radiators 206 and/or a subset of the vertically polarized radiators 208 propagate a signal.

Figure 10:
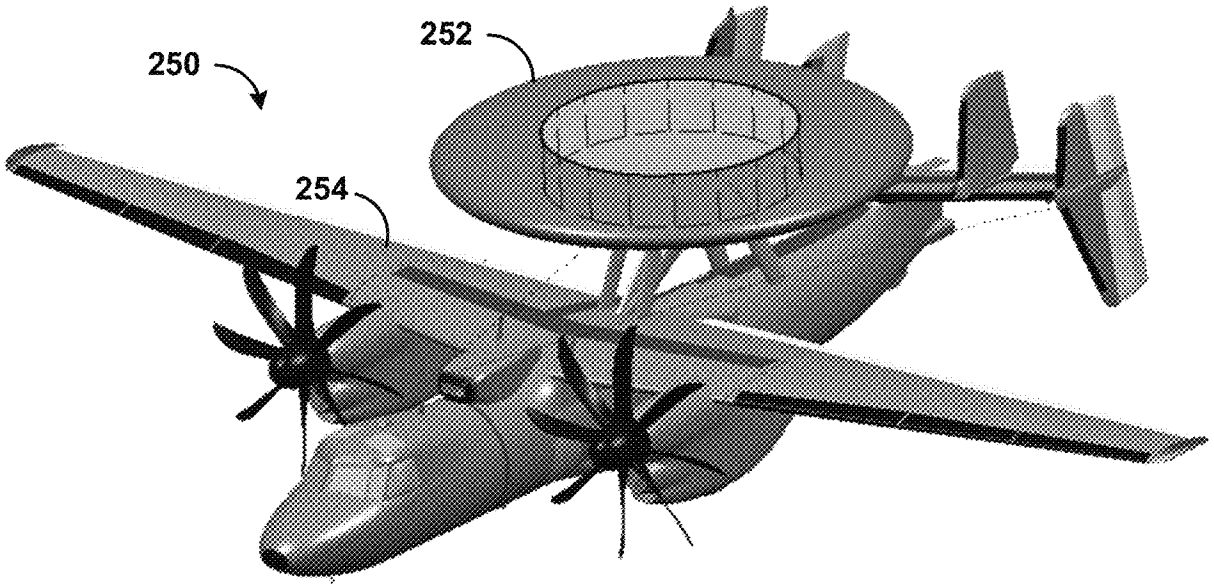
FIG. 10 illustrates an example of an aircraft with an antenna system mounted thereon.

FIG. 10 illustrates an example of an aircraft 250 with the antenna system 252 of FIGS. 5-8 mounted thereon. In the present example, the antenna system 252 is mounted above a front wing 254 of the aircraft 250. In other examples, the antenna system 252 could be mounted in different locations. Since, as described with respect to FIGS. 5-8, the antenna system 252 can generate a BOD in nearly any direction, there is no need for the aircraft 250 to include a rotating mechanism to change the orientation of the antenna system 252. Instead, the aircraft 250 can simply generate control signals (e.g., an input signal) for the antenna system 252 that can cause the antenna system 252 to propagate the BOD in the manner described herein. Since there is no need to change a physical orientation of the antenna system 252, the time needed for generating a beam in a selected direction can be microseconds and the beam can dwell for any period of time.

Figure 11:
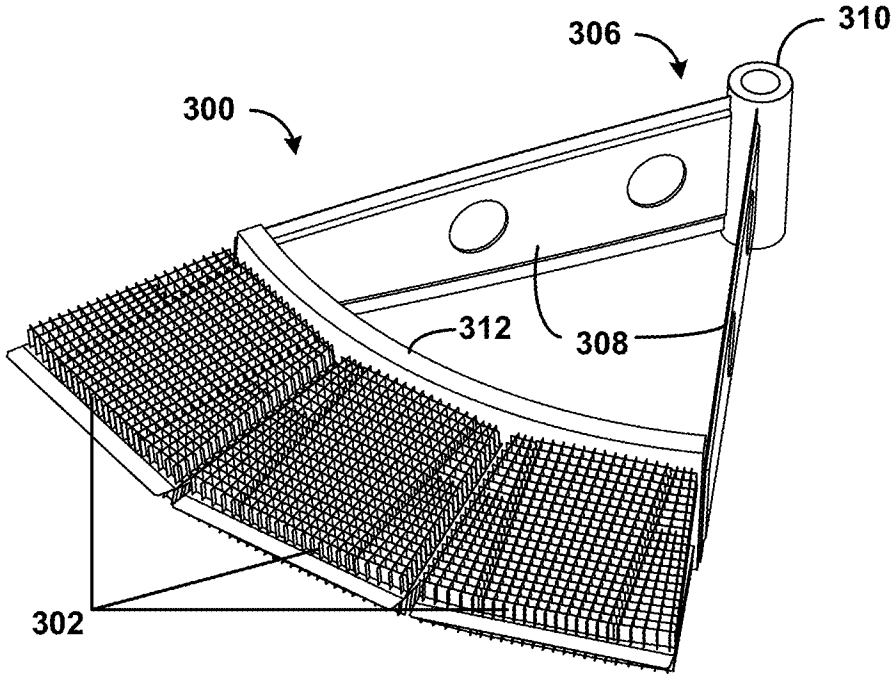
FIG. 11 illustrates an example of an antenna system with an arc shaped array of wedge shaped antenna array panels.

FIG. 11 illustrates an example of arc shaped array 300 of wedge shaped antenna arrays 302. The arc shaped array 300 can be implemented as an element of an antenna system or as an entire antenna system. In the present example, there are three wedge shaped antenna arrays 302, but in other examples, more or less wedge shaped antenna arrays 302 could be employed. Each wedge shaped antenna array 302 could be implemented as the wedge shaped antenna array 4 illustrated in FIG. 2. Moreover, the wedge shaped antenna arrays 302 can be mechanically supported by a truss structure 306 that includes a plurality of legs 308 extending from a common vertex 310. The plurality of legs 308 can be affixed to a sidewall 312, which can be arc shaped. The arc shaped array 300 of wedge shaped antenna arrays 302 can be affixed to the sidewall 312.

In some examples, multiple instances of the arc shaped array 300 can be arranged to achieve a specific desired shape. For example, in some situations, the arc shaped array 300 can be repeated and arranged to form an antenna system with radial symmetry, such as illustrated in FIG. 8.

Figure 12:
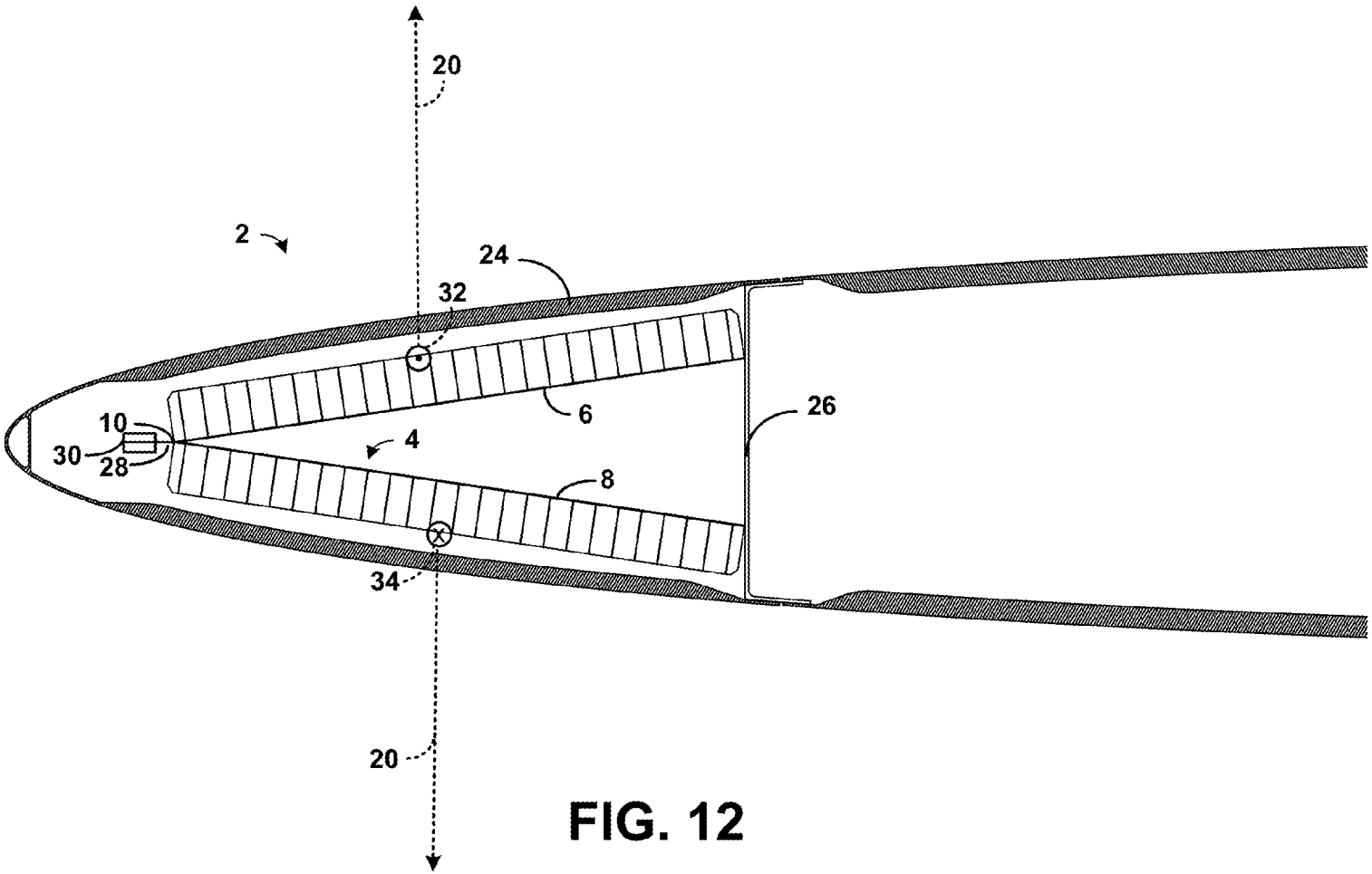
FIG. 12 illustrates an example of an antenna system with a transitional MMR at a vertex.

FIG. 12 illustrates an alternative design of the antenna system 2 illustrated in FIG. 1. For purposes of simplification of explanation, the same reference numbers are employed in FIGS. 1 and 12 to denote the same structure. The antenna system 2 includes a transitional MMR 30 spaced apart from the vertex of the antenna system. The transitional MMR 30 can be mounted on the housing 24 to be positioned between the housing 24 and the vertex 10. The transitional MMR 30 can be implemented as a single MMR and/or with a plurality of MMRs arranged in a linear row (e.g., a strip of MMRs). The transitional MMR 30 can be an active element that omits a ground plane.

Upon activation, the transitional MMR 30 can facilitate horizontal polarization of an EM field, such as the EM field indicated by the arrows 32 and 34 (e.g., directions in and out of the figure). Thus, the parallel (e.g., horizontal) polarization can be parallel to the ground plane of the first panel 6 and the second panel 8. In particular, the transitional MMR 30 can operate as a transition that ties the parallel polarization of the first panel 6 and the second panel 8 together by focusing energy emitted from the first panel 6 and the second panel 8 together. Accordingly, employment of the transitional MMR 30 can further improve propagation characteristics in the plane of the vertex of the antenna system 2.

Figure 13:
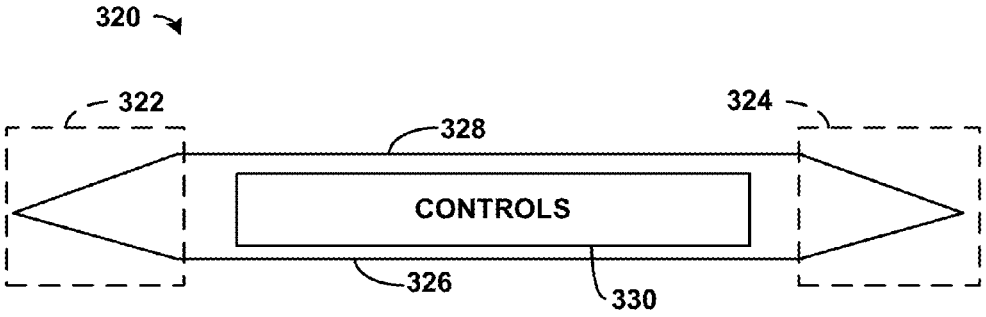
FIG. 13 illustrates a planar example of an antenna system that can transmit a BOD in multiple directions.

FIG. 13 illustrates another example of an antenna system 320. The antenna system 320 can include, for example, a first wedge shaped antenna array 322 and a second wedge shaped antenna array 324. Each of the first and second wedge shaped antenna arrays 322 and 324 can be implemented in a manner similar to the wedge shaped antenna array 4 illustrated in FIG. 4. Each of the first and second wedge shaped antenna arrays 322 and 324 can be positioned in opposing directions from each other. Additionally, the first and second wedge shaped antenna arrays 322 and 324 can be space apart from each other. Moreover, a first array of radiators 326 and a second array of radiators 328 can extend between the first wedge shaped antenna array 322 and the second wedge shaped antenna array 324. Furthermore, controls 330 (e.g., electric circuits) for the antenna system 320 can be in an area between the first and second arrays of radiators 326 and 328.

The shape of the antenna system 320 can resemble a "shark fin". Accordingly, the antenna system 320 can be mounted with a vertical orientation on a vehicle (e.g., a ground vehicle or an aircraft) or other structure such as a tower. Moreover, the antenna system 320 can be relatively narrow such that mounting the antenna system 320 on a vehicle does not significantly increase drag. Additionally, the antenna system 320 can broadcast a beam with a polar angle that can vary by about 180° (elevation diversity) and an azimuth angle that can vary about 360° in a two-dimensional plane (azimuth diversity). Accordingly, the antenna system 320 can provide a BOD in nearly any direction.

Figure 14:
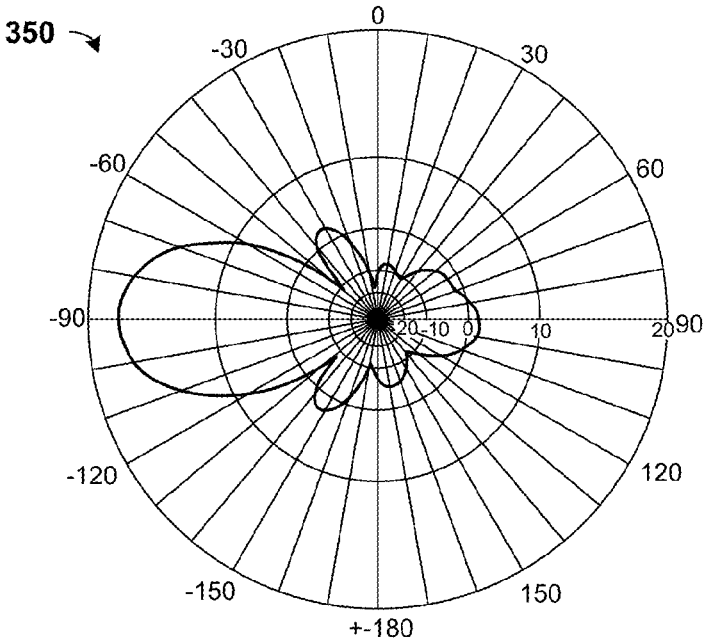
FIG. 14 illustrates an example of a vertically polarized radiation plot of wedge shaped antenna arrays.
Figure 15:
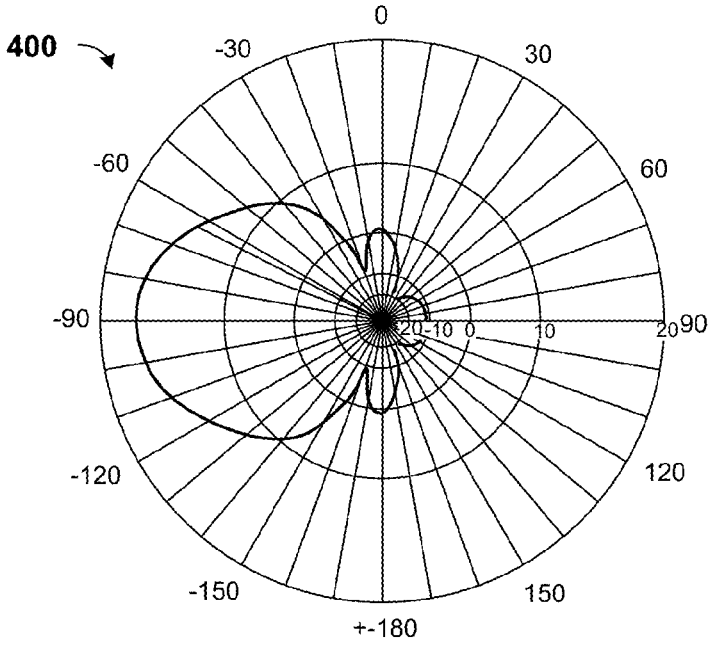
FIG. 15 illustrates an example of a horizontally polarized radiation plot of wedge shaped antenna arrays.

FIG. 14 illustrates a vertically polarized polar radiation plot 350 for a wedged shaped antenna array, such as the wedge shaped antenna array 4 illustrated in FIG. 2. In FIGS. 14 & 15, antenna gain (in decibels(isotropic) (dBi)) is plotted as a function of a polar angle (e.g., vertical angle). As is illustrated, the wedge shaped antenna array achieves a relatively high antenna gain between about −30° and about −150°. Moreover, the wedge shaped antenna array has a peak gain of about 18.5 dBi at an angle of about −90°. The wedge shaped antenna array can achieve excellent coverage at the horizon due to tangential electric field (E-field) orientation.

FIG. 15 illustrates a horizontally polarized polar radiation plot 400 for an array of wedged shaped antenna arrays, such as the arc shaped array 300 of wedge shaped antenna arrays 302 illustrated in FIG. 11. In FIG. 15, antenna gain (in dBi) is plotted as a function of an azimuth angle (e.g., horizontal angle). As is illustrated, the array of wedge shaped antenna arrays achieves a relatively high antenna gain between about −160° and about −20°. Moreover, the array of wedge shaped antenna arrays has a peak gain of about 17.7 dBi at an angle of about −90°. As illustrated, the array of wedge shaped antenna arrays can achieve beam squinting due to parallel E-field orientation that steers beams away from a ground plane.

Where the disclosure or claims recite "a," "an," "a first," or "another" element, or the equivalent thereof, it should be interpreted to include one or more than one such element, neither requiring nor excluding two or more such elements. Furthermore, what have been described above are examples. It is, of course, not possible to describe every conceivable combination of components or methods, but one of ordinary skill in the art will recognize that many further combinations and permutations are possible. Accordingly, the invention is intended to embrace all such alterations, modifications, and variations that fall within the scope of this application, including the appended claims.

What is claimed is:

1. An antenna system comprising:

a plurality of antenna arrays arranged circumferentially about an axis, wherein the antenna system has radial symmetry, each of the plurality of antenna arrays comprising:

a first panel of radiators extending from a vertex in a first substantially linear direction; and a second panel of radiators extending from the vertex in a second substantially linear direction, wherein the first panel of radiators and the second panel of radiators form an angle between about 1 degree and about 45 degrees to enhance gain;

wherein the antenna system is configured to propagate a broadcast beam with a polar or elevation angle within a range of about 180 degrees and an azimuth angle within a range of about 360 degrees.

2. The antenna system of claim 1, wherein each of the first panel of radiators and the second panel of radiators are two-dimensional arrays comprising:

a given set of strips of radiators that are spaced apart from each other; and another set of strips of radiators that are spaced apart from each other, wherein the given and the other set of strips of radiators are perpendicularly arranged.

3. The antenna system of claim 2, wherein the given and the other set of strips of radiators are parallel.

4. The antenna system of claim 1, wherein each radiator of the first panel of radiators and the second panel of radiators further comprises a drive point that is electrically coupled to a signal source.

5. The antenna system of claim 1, wherein the antenna system is configured to propagate an electromagnetic wave in any selected direction between a substantially vertical or elevation direction and a substantially horizontal or azimuth direction.

6. The antenna system of claim 5, wherein the antenna system has an effective aperture equal to about a sum of a length of the first panel of radiators and a length of the second panel of radiators.

7. The antenna system of claim 6, wherein antenna system is configured to stretch the effective aperture in an elevation plane of the antenna system.

8. The antenna system of claim 1, further comprising a housing that encases the first panel of radiators and the second panel of radiators.

9. The antenna system of claim 8, further comprising a transitional radiator positioned between the housing and the vertex, the transitional radiator being configured to focus energy radiated from the first panel of radiators and the second panel of radiators to enable parallel polarization of an electromagnetic field propagating from the first and second panels of radiators.

10. An antenna system comprising:

a plurality of wedge shaped antenna arrays, wherein each of the wedge shaped antenna arrays comprises:

a first two-dimensional panel of radiators extending from a vertex in a first substantially linear direction;

a second two-dimensional panel of radiators extending from the vertex in a second substantially linear direction, wherein the first two-dimensional panel of radiators and the second two-dimensional panel of radiators form an angle between about 1 degree and about 45 degrees; and a transitional radiator positioned near the vertex, the transitional radiator being configured to focus energy radiated from the first two-dimensional panel of radiators and the second two-dimensional panel of radiators to enable parallel or horizontal polarization of an electromagnetic field propagating from the first and second panels of radiators;

wherein each of the first two-dimensional panel of radiators and the second two-dimensional panel of radiators comprise:

a given set of strips of radiators that are spaced apart from each other; and another set of strips of radiators that are spaced apart from each other, wherein the given and the other set of strips of radiators are perpendicularly arranged; and wherein the antenna system has an effective aperture equal to a combined length of the first and second two-dimensional panels of radiators.

11. The antenna system of claim 10, wherein the plurality of wedge shaped antenna arrays have radial symmetry.

12. The antenna system of claim 11, wherein the plurality of wedges in an azimuth direction are collimated to form an antenna with an increased gain.

13. The antenna system of claim 12, wherein the antenna system is configured to propagate a broadcast beam with a polar or elevation angle within a range of about 180 degrees and an azimuth angle within a range of about 360 degrees and the antenna system has a height equal to about one quarter of the effective aperture.

14. The antenna system of claim 10, further comprising a backplane configured to:

receive an input signal; and provide the input signal to a subset of the plurality of wedge shaped antenna arrays.

15. An aircraft comprising the antenna system of claim 10 mounted thereon.

16. An antenna system comprising:

a plurality of wedge shaped antenna arrays arranged in a shape with radial symmetry, wherein each of the wedge shaped antenna arrays comprises:

a first two-dimensional panel of radiators extending from a vertex in a first substantially linear direction; and a second two-dimensional panel of radiators extending from the vertex in a second substantially linear direction, wherein the first two-dimensional panel of radiators and the second two-dimensional panel of radiators form an angle between about 1 degree and about 45 degrees;

wherein the plurality of wedge shaped antenna arrays are arranged in one of a planar geometry a circular geometry and a cylindrical geometry; and wherein the antenna system is configured to propagate a broadcast beam with a polar or elevation angle that within a range of about 180 degrees and an azimuth angle within a range of about 360 degrees, wherein 180 degrees of the plurality of wedge shaped antenna arrays are collimated together to form an antenna with an increased gain.

17. The antenna system of claim 16, wherein the antenna system has an effective aperture equal to about a sum of the areas of the first and the second two-dimensional panels of radiators of a given one of the plurality of wedge shaped antenna arrays.

* * * * *